United States Patent [19]

Hayase et al.

[11] Patent Number: 4,515,513

[45] Date of Patent: May 7, 1985

[54] ROTARY COMPRESSOR WITH INNER AND OUTER CYLINDERS AND AXIAL INSERT TYPE DISCHARGE VALVES

[75] Inventors: Isao Hayase; Masao Mizukami; Atsuo Kishi, all of Katsuta, Japan

[73] Assignee: Hitachi, Ltd., Tokyo, Japan

[21] Appl. No.: 495,147

[22] Filed: May 16, 1983

[30] Foreign Application Priority Data

May 19, 1982 [JP] Japan ..... 57-83124

[51] Int. Cl.[3] ..... F04C 18/00; F04C 29/00; F04C 29/04

[52] U.S. Cl. ..... 418/101; 418/178; 418/179; 418/270

[58] Field of Search ..... 418/101, 178, 179, 270

[56] References Cited

U.S. PATENT DOCUMENTS

| | | | |
|---|---|---|---|
| 2,785,851 | 3/1957 | Menon | 418/101 |
| 2,816,702 | 12/1957 | Woodcock | 418/179 |
| 4,088,428 | 5/1978 | Bannister et al. | 418/270 |
| 4,149,834 | 4/1979 | Eiermann | 418/270 |

FOREIGN PATENT DOCUMENTS

| | | | |
|---|---|---|---|
| 2918554 | 11/1980 | Fed. Rep. of Germany | 418/178 |
| 56-31689 | 3/1981 | Japan . | |
| 56-101093 | 8/1981 | Japan . | |

*Primary Examiner*—John J. Vrablik

*Attorney, Agent, or Firm*—Antonelli, Terry & Wands

[57] ABSTRACT

A rotary compressor comprises a rotor, a cylinder having an inner surface slidably contacting the rotor at one or more portions thereof, side plates disposed on both sides of the cylinder for supporting a rotor driving shaft, and axial insert type discharge valves disposed inside the cylinder. The cylinder includes an inner cylinder having an inner surface slidably contacting the rotor, and an outer cylinder surrounding the whole of the outer periphery of the inner cylinder.

9 Claims, 4 Drawing Figures

ROTARY COMPRESSOR WITH INNER AND OUTER CYLINDERS AND AXIAL INSERT TYPE DISCHARGE VALVES

BACKGROUND OF THE INVENTION

The present invention relates to a rotary compressor, e.g., a slidable vane compressor or a Wankel-type rotary piston compressor, and more particularly to a rotary compressor improved in cylinder structure.

In general, a slidable vane compressor has a cylindrical rotor and a cylinder slidably contacting the rotor at one or more portions thereof. The cylindrical rotor has a plurality of substantially radial slits each movably receiving a slidable vane. The cylinder is closed at both its axial ends by respective side plates so that compression chambers are defined by the vanes, the cylinder and the side plates. In operation, as the rotor is rotated by a torque applied thereto, the volumes of the compression chambers are changed to compress a fluid.

In the conventional slidable vane compressor, since the tips of the slidable vanes slide on an inner surface of the cylinder at high speed, the material for the cylinder is inconveniently restricted to iron-based metals. Accordingly, the manufacture of the conventional cylinder is such that the cylinder is integrally formed from a cast iron, followed by a polishing of the inner surface thereof.

It has been known that, as discharge valves for the slidable vane compressor of this kind, such discharge valves are employed and can be inserted into axial openings parallel to the axis of the cylinder (the valve will be referred to as an "axial insert type discharge valve", hereinafter). The employment of the axial insert type discharge valve eliminates the necessity to provide a discharge chamber of high pressure on the outer periphery of the cylinder, and makes it possible to prevent deformation of the cylinder due to a high pressure and prevent leakage of a fluid through the gap between the slidable vane tip and the cylinder inner surface resulting from the deformation. Moreover, it is possible to expect the cylinder to be reduced in diameter and improved in its heat radiation performance. Rotary compressors having such axial insert type discharge valves have been disclosed in, for example, U.S. Pat. Nos. 4,088,428 and 4,149,843, and Japanese Patent Laid-Open No. 101093/81.

Since the cylinder in the conventional slidable vane compressors is a cast article made of an iron-based metal, however, it is difficult to form the axial opening for receiving the discharge valve and form a discharge bore for providing a communication between the compression chamber and the axial opening. More specifically, the discharge bore cannot be machined from the outside of the cylinder; hence, the discharge bore is conventionally machined from the inside of the cylinder by means of a special machine. In consequence, the discharge bore cannot be machined with a satisfactory accuracy, so that such a countermeasure has been required that a sleeve is separately provided to the axial opening to ensure the dimensional accuracy of the discharge bore, as seen in U.S. Pat. No. 4,149,834.

On the other hand, it has been known to provide a rotary compressor having a discharge valve exposed to the outside of the cylinder. In the design of such rotary compressors, it is often attempted to reduce the cylinder weight by adopting a composite cylinder structure consisting of an inner cylinder made of an iron-based metal and an outer cylinder made of a cast light metal enclosing most part of the outer peripheral surface of the inner cylinder to allow a part of the inner cylinder to be revealed through the outer cylinder, as shown in, for example, Japanese Patent Laid-Open No. 31689/1981. This rotary compressor cannot offer the above-mentioned advantage of the rotary compressor having the axial insert type discharge valve although it has the cylinder of light weight.

SUMMARY OF THE INVENTION

Accordingly, an object of the invention is to provide an improved rotary compressor which permits an easy formation of axial openings for receiving axial insert type discharge valves.

Another object of the invention is to provide improved rotary compressor which permits reduction of a cylinder in weight.

Still another object of the invention is to provide an improved rotary compressor which permits an inner surface of a cylinder to be highly accurately formed from the beginning and consequently facilitate the finishing of the inner surface of the cylinder thereby to allow a higher productivity.

To these ends, according to the invention, there is provided a rotary compressor comprising a cylinder having axial insert type discharge valves, the cylinder including an inner cylinder having an inner surface slidably contacting a rotor, and an outer cylinder surrounding the whole of the outer periphery of the inner cylinder.

DESCRIPTION OF THE PREFERRED EMBODIMENTS

An embodiment of the slidable vane compressor of the invention, employed for an automotive air-conditioner, will be described hereinunder in detail with reference to the accompanying drawings.

Figure 1:
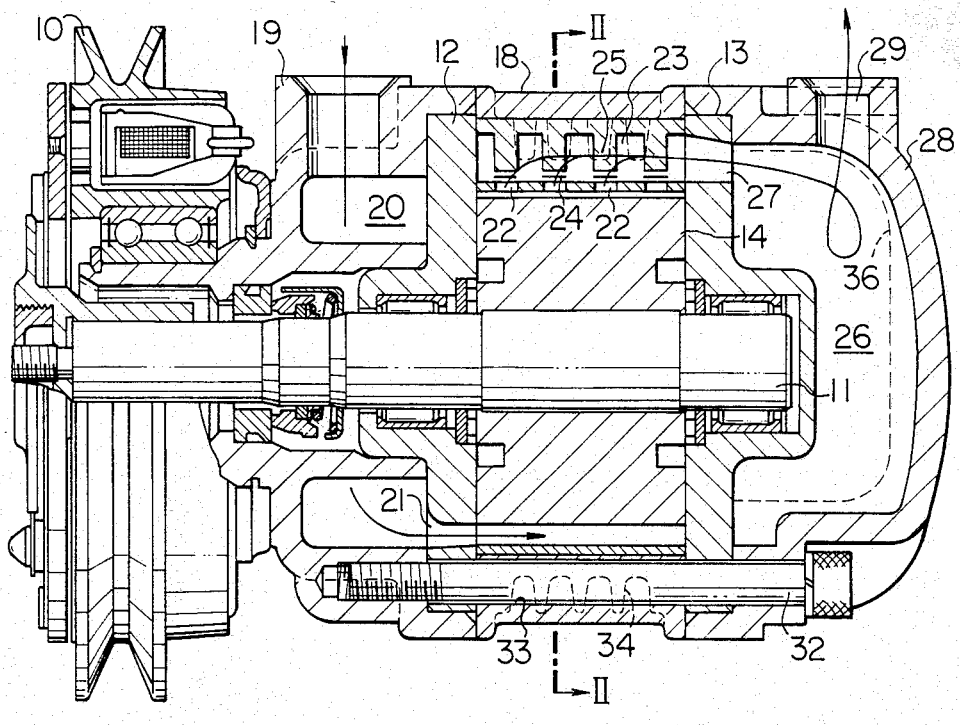
FIG. 1 is a longitudinal sectional view of an embodiment of the slidable vane compressor in accordance with the invention.
Figure 2:
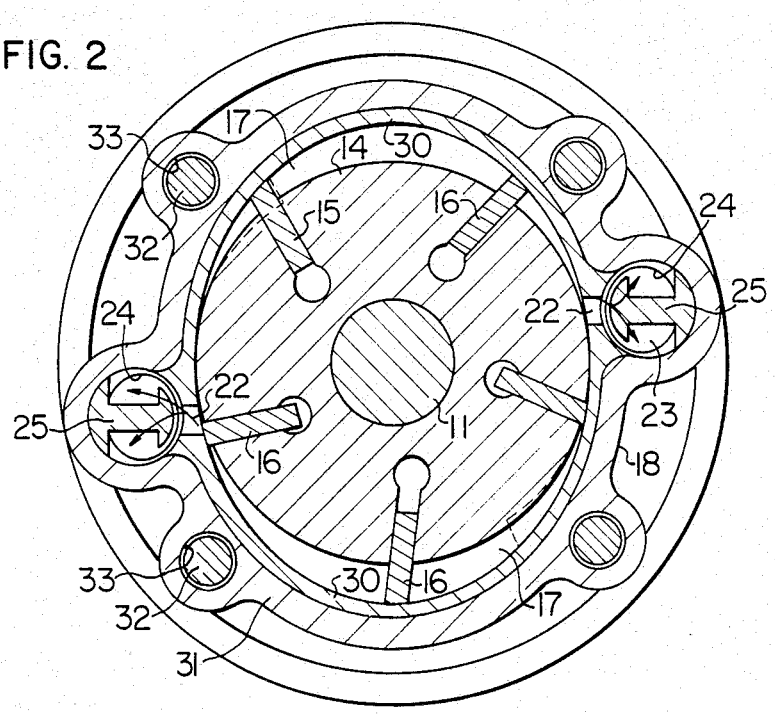
FIG. 2 is a transverse sectional view taken along a line II—II of FIG. 1.

Referring first to FIGS. 1 and 2, the slidable vane compressor has a rotor driving shaft 11 rotated by a torque derived from an engine through a pulley 10. The rotor driving shaft 11 is supported by bearings provided on a pair of side plates 12, 13. A cylindrical rotor 14 is disposed between the side plates 12, 13. The cylindrical rotor 14 is provided with substantially radial slits 15 opened to the outer peripheral surface thereof. Slidable vanes 16 are fitted in the slits 15, respectively. Moreover, a cylinder 18 is disposed between peripheral portions of the pair of side plates 12, 13, thereby defining two compression chambers between an inner surface of the cylinder 18 and an outer periphery of the cylindrical rotor 14. The cylinder 18 includes an inner cylinder 30 having an inner surface slidably contacting the tips of the slidable vanes 16, and an outer cylinder 31 surrounding the whole of an outer periphery of the inner cylinder 30. The inner surface of the inner cylinder 30 is formed in an epitrochoid shape. As the cylindrical rotor 14 rotates, the tips of the slidable vanes 16 slide on the inner surface of the inner cylinder 30, and a volume of each compression chamber 17 gradually decreases, thereby allowing the compression stroke to take place.

In this case, a front cover 19 is attached to the front plate 12 of the pair of side plates to define a suction chamber 20 of low pressure between the front cover 19 and the front plate 12. A coolant is introduced into the compression chambers 17 from the suction chamber 20 through an intake bore 21 formed in the front plate 12. The coolant compressed in the compression chambers 17 is introduced into axial openings 23 through discharge bores 22 formed in the inner cylinder 30 and through discharge valves. Each of the axial openings 23 has a discharge valve received therein for opening and closing the corresponding discharge bore 22. The discharge valve has a reed 24 and a valve retainer 25. The compressed coolant of high pressure pushes up the reeds 24 against the elasticity thereof and is discharged into the axial openings 23. On the other hand, a discharge chamber 26 is defined between the rear plate 13 and a rear cover 28. The rear plate 13 has therein a discharge passage 27 for providing a communication between the axial openings 23 and the discharge chamber 26. The high-pressure coolant introduced into the axial openings 23 passes through the discharge passage 27, the discharge chamber 26 and an oil separator 36 and emerges from an outlet 29.

The construction of the cylinder 18 according to the invention will be described hereinunder in detail. The inner cylinder 30 is sintered from an iron-based metal so as to be able to satisfactorily endure the sliding of the slidable vanes 16. The inner cylinder 30 covers the whole of the inner surface of the cylinder 18. The thickness of the inner cylinder 30 is preferably less than half the thickness of the outer cylinder 31. The inner cylinder 30 has outer peripheral surface portions which respectively define part of the inner surfaces of the axial openings 23, i.e., valve seat portions at which reeds 24 closely contacts the inner cylinder 30. On the other hand, the outer cylinder 31 is made of a metal lighter than the iron-based metal constituting the inner cylinder 30. The outer cylinder 31 in accordance with the embodiment is die-cast from aluminum. After the inner cylinder 30 is sintered, the discharge bores 22 are formed in the inner cylinder 30 from the outside thereof by the use of a machining means such as a drill or the like. Thereafter, the inner cylinder 30 is placed in a mold to die-cast the outer cylinder 31 from aluminum directly on the outside of the inner cylinder 30. The outer cylinder 31 surrounds the whole of the outer periphery of the inner cylinder 30, and has the rest of the inner surface of each axial opening 23 formed in a portion of an inner surface of the outer cylinder 31. Moreover, the outer cylinder 31 has bores 33 formed therein for receiving through-bolts 32 for connecting the front cover 19 and the rear cover 28 to each other with the cylinder 18 sandwiched therebetween.

The rotary compressor according to the invention having the construction described above has an advantage that the discharge bores 22 can be easily machined with a sufficiently high accuracy, since it is possible to form the discharge bores 22 from the outside of the inner cylinder 30 after forming the same. Moreover, since the outer cylinder 31 is made of a material lighter than an iron-based metal, the cylinder 18 can be greatly reduced in weight. Further, since the inner cylinder 30 is sintered, it can be formed with a high accuracy from the beginning so that it becomes possible to omit the pre-finishing and moreover, it is possible to largely reduce the finishing margin in finishing the inner surface shape of the cylinder 18 in the final step. Accordingly, the productivity in producing the cylinder 18 is greatly improved. It is also possible to impregnate the inner cylinder 30 with a lubricating oil, since the sintered inner cylinder 30 is porous. Although the porous inner cylinder 30 is unsatisfactory in airtightness, the airtightness of the cylinder 18 is ensured by the fact that the whole of the outer periphery of the inner cylinder 30 is surrounded by the outer cylinder 31.

Figure 3:
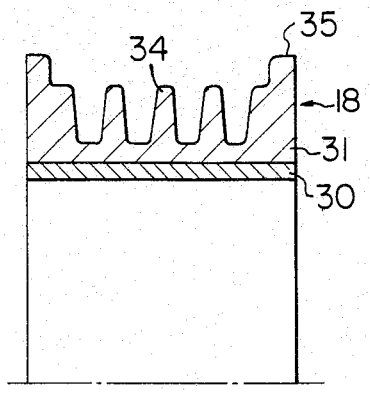
FIG. 3 is a longitudinal sectional view of a part of a cylinder of the slidable vane compressor shown in FIG. 1.

FIG. 3 is a longitudinal sectional view of a part of the cylinder 18 of the slidable vane compressor shown in FIG. 1. Flanges 35 are formed at both axial ends of the outer periphery of the outer cylinder 31, and a plurality of circumferential ribs 34 are provided on the outer peripheral surface of the outer cylinder 31 between these flanges 35. Therefore, the outer cylinder 31 becomes lightweight as well as high in strength. Moreover, the cylinder 18 is improved in its heat radiation performance, and the compressor is improved as a whole in durability and performance.

Figure 4:
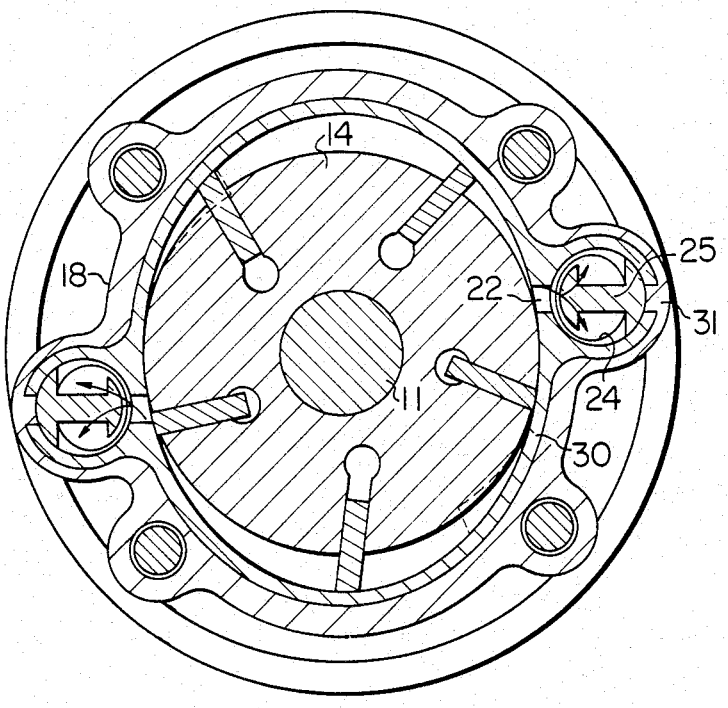
FIG. 4 is a transverse sectional view of another embodiment of the slidable vane compressor in accordance with the invention.

FIG. 4 is a transverse sectional view of another embodiment of the invention. In this embodiment, essentially the whole of each axial opening 23 for receiving the discharge valve is formed inside the inner cylinder 30. Consequently, essentially the whole of the axial opening 23 is made of an iron-based metal, so that the whole of the inner surface of the axial opening 23 is further improved in durability as compared with the first-described embodiment. In addition, each of the discharge bores 22 is formed by carrying out boring from an outer peripheral portion of the inner cylinder 30 toward the inner surface thereof across the corresponding axial opening. The extra periphery-side bore made by the above boring operation is closed simultaneously with the formation of the outer cylinder 31 from aluminum by means of die casting. Accordingly, also in this embodiment, the airtightness of the cylinder 18 is satisfactorily ensured, since the whole of the outer periphery of the inner cylinder 30 is surrounded by the outer cylinder 31 die-cast from aluminum.

As will be fully understood from the foregoing description, the invention facilitates the formation of the discharge bores of the cylinder as well as permits the cylinder to be reduced in weight and improved in productivity. Therefore, it is possible to improve the fuel consumption ratio of a vehicle mounting the rotary compressor according to the invention, and it becomes possible to reduce both the production cost of the rotary compressor and the production equipment.

It is to be noted here that although the above-described embodiments pertain to the slidable vane compressor having two compression chambers, these embodiments are not exclusive and the invention can be readily applied to the slidable vane compressor having one or three or more compression chambers. Moreover, the invention is also well applicable to other rotary compressors, e.g., the Wankel-type rotary piston compressor, than the slidable vane compressor.

In addition, although in the above-described embodiments the inner cylinder 30 is sintered from an iron-based metal, it may be formed by means of precision casting, forging or the like.

What is claimed is:

1. A rotary compressor comprising:

a rotor;

a cylinder having an inner surface slidably contacting said rotor at one or more portions thereof;

side plates disposed on both sides of said cylinder for supporting a rotor driving shaft;

one or more compression chambers defined by said rotor, said cylinder and said side plates;

axial openings formed in said cylinder; and axial insert type discharge valves disposed inside said axial openings, wherein said cylinder includes an inner cylinder having an inner surface slidably contacting said rotor, and an outer cylinder surrounding the whole of an outer periphery of said inner cylinder, said inner cylinder and said outer cylinder are inseparably connected with each other, said axial openings each include an inner surface defined by said inner cylinder and said outer cylinder, and said inner cylinder is formed with discharge bores for providing communication between said axial openings and said compression chambers.

2. A rotary compressor according to claim 1, wherein said inner cylinder is made of an iron-based metal, and said outer cylinder is made of a material lighter than the iron-based metal.

3. A rotary compressor according to claim 2, wherein said inner cylinder is sintered.

4. A rotary compressor according to claim 2, wherein said outer cylinder is die-cast from aluminum directly on the outside of said inner cylinder.

5. A rotary compressor according to claim 1 wherein said inner cylinder includes valve seats for said discharge valves.

6. A rotary compressor according to claim 1, wherein essentially the whole of the inner surface of each of said axial openings is defined by said inner cylinder with only a portion of said inner surface diametrically opposed to the discharge bore therein being defined by said outer cylinder.

7. A rotary compressor according to claim 1, wherein said outer cylinder is provided with circumferential ribs formed on the outer periphy thereof and extending in a circumferential direction.

8. A rotary compressor according to claim 1, wherein said rotary compressor has two compression chambers, and said cylinder includes two axial openings each receiving said discharge valve.

9. A rotary compressor according to claim 1, wherein said rotary compressor is a slidable vane compressor, and said rotor includes slidable vanes sliding outward and inward in a plurality of slits formed in said rotor, respectively.

* * * * *